United States Patent [19]

Cortes

[11] 3,951,219

[45] Apr. 20, 1976

[54] DRILL TOOL COMPRISING A CORE BARREL AND A REMOVABLE CENTRAL PORTION

[75] Inventor: Abel C. Cortes, Paris Cedex, France

[73] Assignee: Compagnie Francaise des Petroles, Paris Cedex, France

[22] Filed: Apr. 11, 1974

[21] Appl. No.: 459,990

[30] Foreign Application Priority Data

Apr. 17, 1973 France ..... 73.13967

[52] U.S. Cl. ..... 175/107; 175/236; 175/246

[51] Int. Cl.[2] ..... E21B 3/12; E21B 25/00

[58] Field of Search ..... 175/232, 244, 236–239, 175/246–249, 257, 260, 107

[56] References Cited

UNITED STATES PATENTS

| | | | |
|---|---|---|---|
| 1,948,632 | 2/1934 | Barrett et al. | 175/236 |
| 2,020,599 | 11/1935 | Barrett et al. | 175/257 |
| 2,138,006 | 11/1938 | Howard | 175/239 X |
| 2,153,815 | 4/1939 | Snyder | 175/257 X |
| 2,173,676 | 9/1939 | Boyd | 175/248 |
| 2,189,057 | 2/1940 | Copelin | 175/246 |
| 2,234,264 | 3/1941 | Lang | 175/236 X |
| 2,258,352 | 10/1941 | Catland et al. | 175/257 X |
| 2,357,907 | 9/1944 | Phillips | 175/236 |
| 2,944,792 | 7/1960 | Gros | 175/107 |
| 3,055,440 | 9/1962 | Tiraspolsky et al. | 175/107 |

FOREIGN PATENTS OR APPLICATIONS

| | | | |
|---|---|---|---|
| 1,195,283 | 11/1959 | France | 175/107 |

*Primary Examiner*—Ernest R. Purser
*Attorney, Agent, or Firm*—Sughrue, Rothwell, Mion, Zinn & Macpeak

[57] ABSTRACT

Apparatus for interchanging the central portion of a drill tool with a core barrel is disclosed. The interchange is effectuated without the need for raising the drilling tool with the drive turbine. Both the core barrel and the central portion of drilling tube have barrel tubes associated therewith and a seating associated with a receiver tube rotating with the tool holds the barrel tube in a vertical position. The end of the core barrel is spaced from the inside end of the barrel of the drilling tool to avoid friction and facilitate the cutting of the core.

5 Claims, 7 Drawing Figures

1
2
2
7
9
10
12
13
14
11
14a
19a
20
19
4
18
17
5
3
24
6
23
25
16
22
15
8

36
40
41
42
43
48
45
52a
46
56
44
38
V
V
52
50
54
47
31
34
30
51
49

DRILL TOOL COMPRISING A CORE BARREL AND A REMOVABLE CENTRAL PORTION

BACKGROUND OF THE INVENTION

Field of the Invention

The invention refers to a drilling device designed for making the central portion of the drill tool interchangeable with a core barrel without necessitating raising the tool with its driving turbine.

PRIOR ART

The value of such a tool which is already obvious when it is a question of drilling on land, has considerable importance when it is a question of carrying out drilling in the sea and particularly in deep water.

In view of the relative fragility of the cores that are taken in the course of a drilling it is clear, particularly when the drive is effected by turbine, that the core barrel must be fixed with respect to the shaft of the turbine and that the core must in addition be screened from the high pressure of the injection mud. The sole known method of execution for resolving the problem presented was to fix the core barrel to the casing at a level located above the turbine and to isolate the core from the pressure of the injection mud while enabling the mud rising in the core barrel to escape. This therefore brought about a double obligation: on the one hand that of providing a special channel opening out in the vicinity of the casing into a zone of high pressure and secondly of arranging seals between the core barrel and the rotating shaft of the turbine. However, with these seals being subjected to considerable speeds ranging from at least 600 r.p.m. to more than 1000 r.p.m., these devices could not have a life time sufficient for the purpose it was intended to achieve, that is, speed of drilling.

Further, because of the connection between the casing and the core barrel it was not possible to exchange a core barrel with the central position of the drilling tool so that it was not possible to proceed with high-speed drilling.

SUMMARY OF INVENTION

The principle object of the present invention is to provide a drilling device the core barrel and the drill tool central portion of which are interchangeable. The present invention being is also characterized in that the core barrel and the removable central portion of the tool comprise each a bearer tube, this tube being held by a seating on a receiver tube revolving with the tool, the bearer tube being isolated at its top end from the injection or drilling mud by a part having a seal applied against the receiver tube revolving with the tool, the core barrel and the removable central portion comprising in addition channels for circulation of the mud at a pressure less than the pressure of the mud located above the sealing part.

The immediate consequence of this arrangement is that by reason alternatively of the seat receiving either the core barrel or the central portion of the drilling tool or of the mud pressure exerted on the seal part, vertical application of the core barrel or of the removable central portion of the tool is insured without any other device. It is therefore sufficient to locate either the core barrel or the central portion of the tool with a simple conventional fishing tool in order to be able to bring to the surface one or other of these units. It will likewise be observed that their return to place is just as easy since the condition necessary to their support is first of all their reintroduction into a tube, which is a commonplace operation.

Another object of the invention is a device of the type indicated, characterized further in that the core barrel is suspended inside the said receiver tube revolving with the tool by means of a ball-bearing assembly, the bearings being interposed between the bearer tube of the core barrel and a bearing support integral with the part having a seal, which is mounted on the receiver tube revolving with the tool.

This arrangement offers advantages in the case of a drive by turbine since on the one hand the core barrel is necessarily isolated from the injection mud from the turbine and on the other hand it no longer has a need of being made integral with the casing as in previous solutions in order to avoid its being driven by the shaft of the turbine.

Another object of the invention is a device of this type in which a mud outlet circuit is provided at the top of the core by forming orifices in the support of the core barrel at the level of the bearings as well as in the bearing support which is integral with the part having a seal so that the mud flows from the core barrel to the bottom end of the turbine shaft in order to rejoin the mud which has served for driving the turbine.

Thus, contrary to the solution necessitating the outlet of the mud into a region in which the mud pressure is considerable, the circuit employed in accordance with the invention enables easier circulation of the mud since it no longer opens into a region in which reigns a higher pressure, while enabling lubrication of the bearings.

Other advantages and characteristics of the invention will become apparent from the following detailed description made with reference to the attached drawing which illustrates by way of non-restrictive example a preferred embodiment of a turbine drilling tool.

DESCRIPTION OF THE PREFERRED EMBODIMENT

Drilling and coring by means of a tool driven by a turbine are known operations and the means employed being also known, it will be understood that only the new means employed for the execution of a turbine drilling device the tool central portion of which is interchangeable with a core barrel in accordance with the invention will be described completely.

Figure 1:
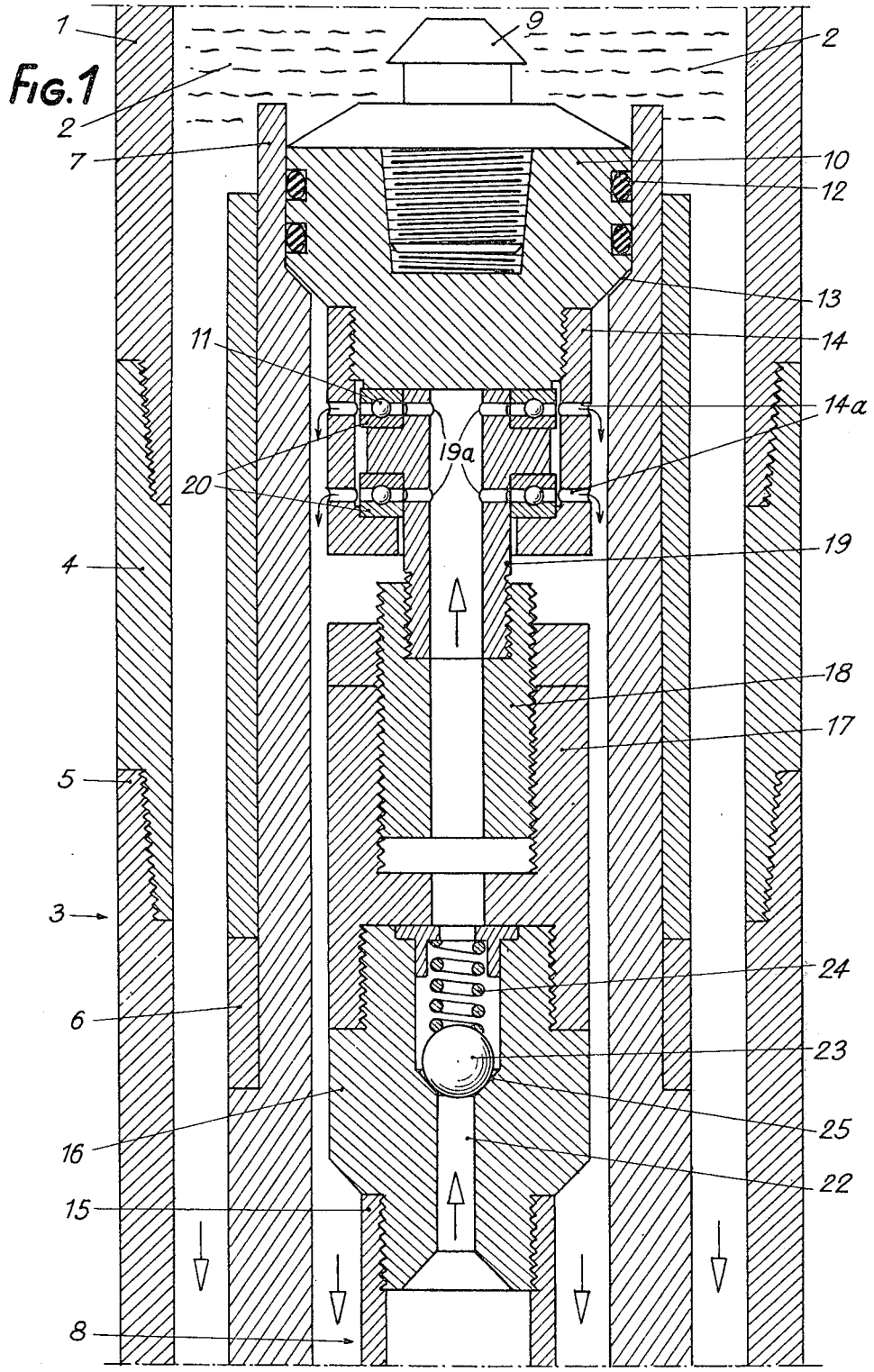
FIG. 1 is a diagrammatic view in axial section of the upper portion of the assembly formed by the device equipped with a core barrel, FIG. 2 - the diagrammatic view in axial section of the lower portions of the device and of the elements of the core barrel, illiminating non-essential details of the bit shown in subsequent figures.
Figure 2:
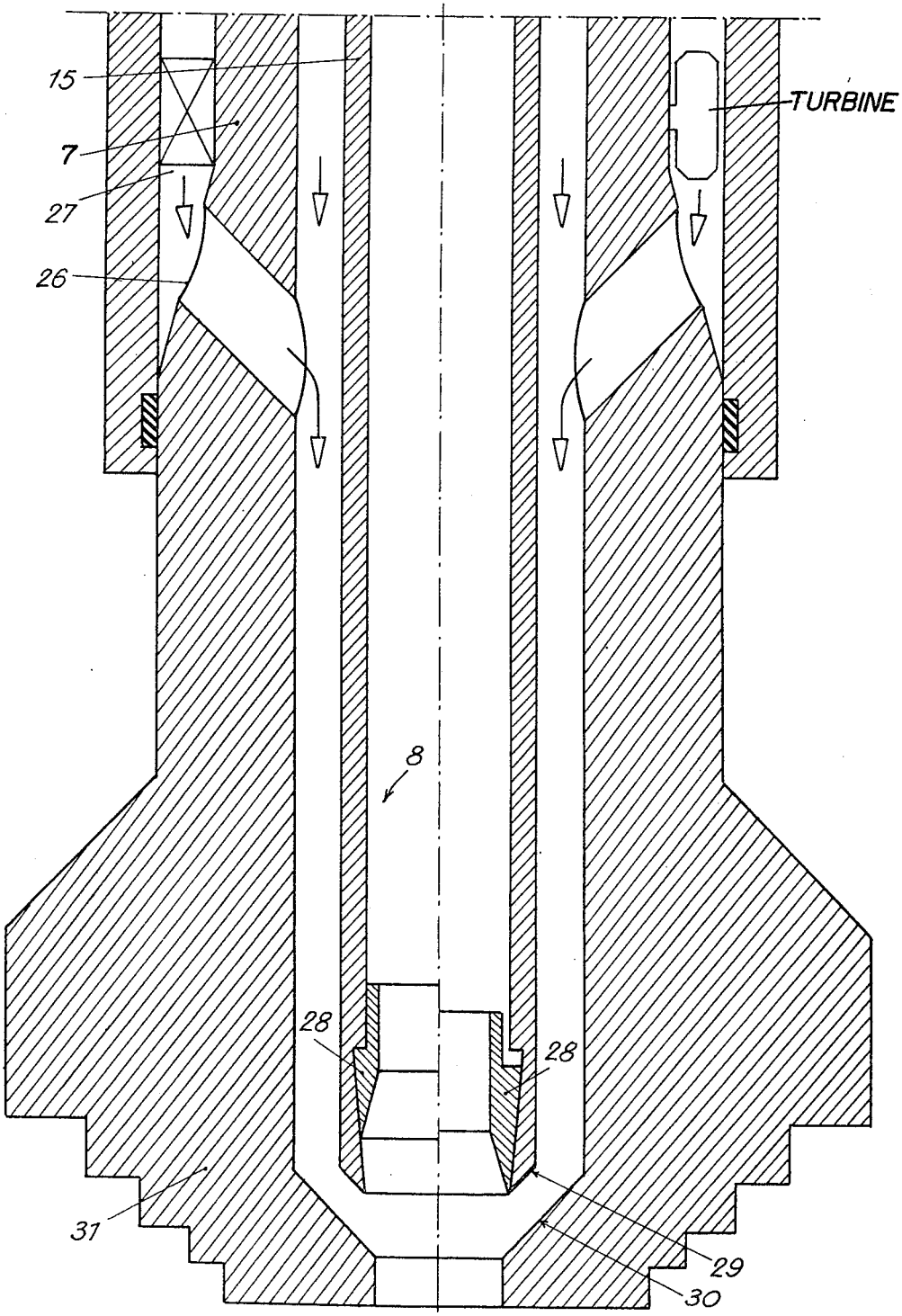

Generally, as shown in FIGS. 1 and 2 the casing 1 receives the injection mud 2 at high pressure for driving the drilling turbine 3 to which it is fixed by the coupling 4 screwed to the outer upper portion 5 of the turbine. The rotating shaft 6 of the turbine comprises at its upper end a receiver tube for guidance 7 for the introduction and support of the core barrel assembly designated by the general reference 8. This tube 8 is connected at its upper portion to a fishing head 9 fixed to a part 10 bearing annular seals 12, by a ball-bearing mounting, the latter being represented at 11. The part 10 rests on a retainer seating 13 in the tube 7 integral with the rotating shaft 6 of the turbine. A housing 14 fixed to the lower portion of the sealing part 10 below its seating 13, contains the ball-bearing assembly locking the tube 15 of the core barrel 8 to the fishing part 9 by means of elements 16, 17, and 18 and the coupling 19. The outer surface of the housing 14 exhibits sufficient clearance from the receiver tube 7 driven by the rotating shaft of the turbine to ensure free flow of the mud in the core bearer tube 15. The latter flows through the central channels in the parts 16 to 18 and the coupling 19 and thence through the orifices 19a provided at the level of the balls 11 and through corresponding orifices 14a in the housing 14, into the passage located between the receiver tube 7 integral with the shaft 6 of the turbine and the core barrel 8. Lubrication is thus obtained of the balls 11 in their races 20. The assembly which has just been described thus shows that the core barrel assembly 8 is suspended by means of the coupling 19, the balls 11 in the races 20 and the housing 14, from the receiver tube 7 integral with the rotating shaft of the turbine. Because of the very high pressure exerted on the fishing head 9 by the injection mud and of the maintaining of the coupling 19 at the constant level with respect to the housing 14 because of the races 20, it can be seen that although the core barrel assembly 8 cannot be displaced vertically it can easily be displaced in a movement of relative rotation with respect to the rotating shaft of the turbine, the bearings 11 having very low friction. The core collected under these conditions is therefore extremely well preserved.

The element 16 is a valve-part of the opening of which depends on the pressure of the mud present in the core bearer tube 15. This conventional part can therefore be preserved. The flow of the mud contained in this tube is insured by the channel 22 which is normally blocked by the ball 23 being biased by the spring 24 against its seating 25.

In FIG. 2 are found again the bearer tube 15 for the core barrel and the bottom end of the shaft 6 between which the mud circulates after having served for lubrication of the balls 11. It will be observed that this mud is mixed compulsorily in the region 26 with the mud coming from the outlet 27 from the turbine. As the latter can be of any type and has no influence upon the invention it has not been represented and forms part of the cutaway effected between the lower and upper edges of FIGS. 1 and 2 respectively. The element 28 represented on the left of the centerline in the drilling position and on the right in the position for cutting out the core being conventional parts, it is unnecessary to describe putting them into action, their control being already known and not forming part of the invention. It will be observed that in accordance with the invention the end 29 of the core barrel 8 exhibits a certain clearance from the end 30 of the accommodation of the barrel in the tool 31 in order to avoid any friction between the lower portion of the barrel 15 of the core barrel assembly 8 and the tool 31 driven by the shaft 6 of the turbine.

Figure 3:
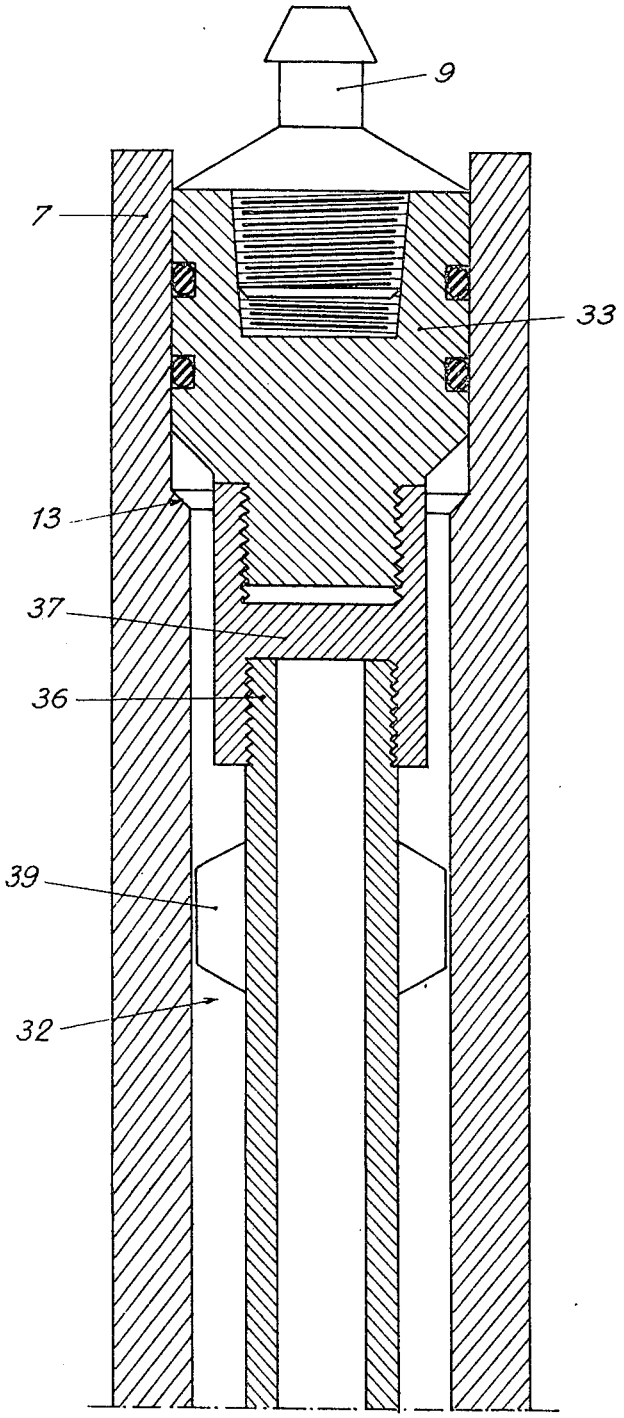
FIG. 3 - the diagrammatic view in axial section of the upper portion of the assembly formed by the device equipped with the removable central portion of the tool, FIG. 4 - the diagrammatic view in section of the lower portion of the device equipped with the removable central portion of the tool, FIG. 5 - the view in section of the lateral connection of the removable central portion of the tool to the device, taken along the line V — V in FIG. 4, showing details of the completed bit assembly not illustrated in FIG. 2.
Figure 4:
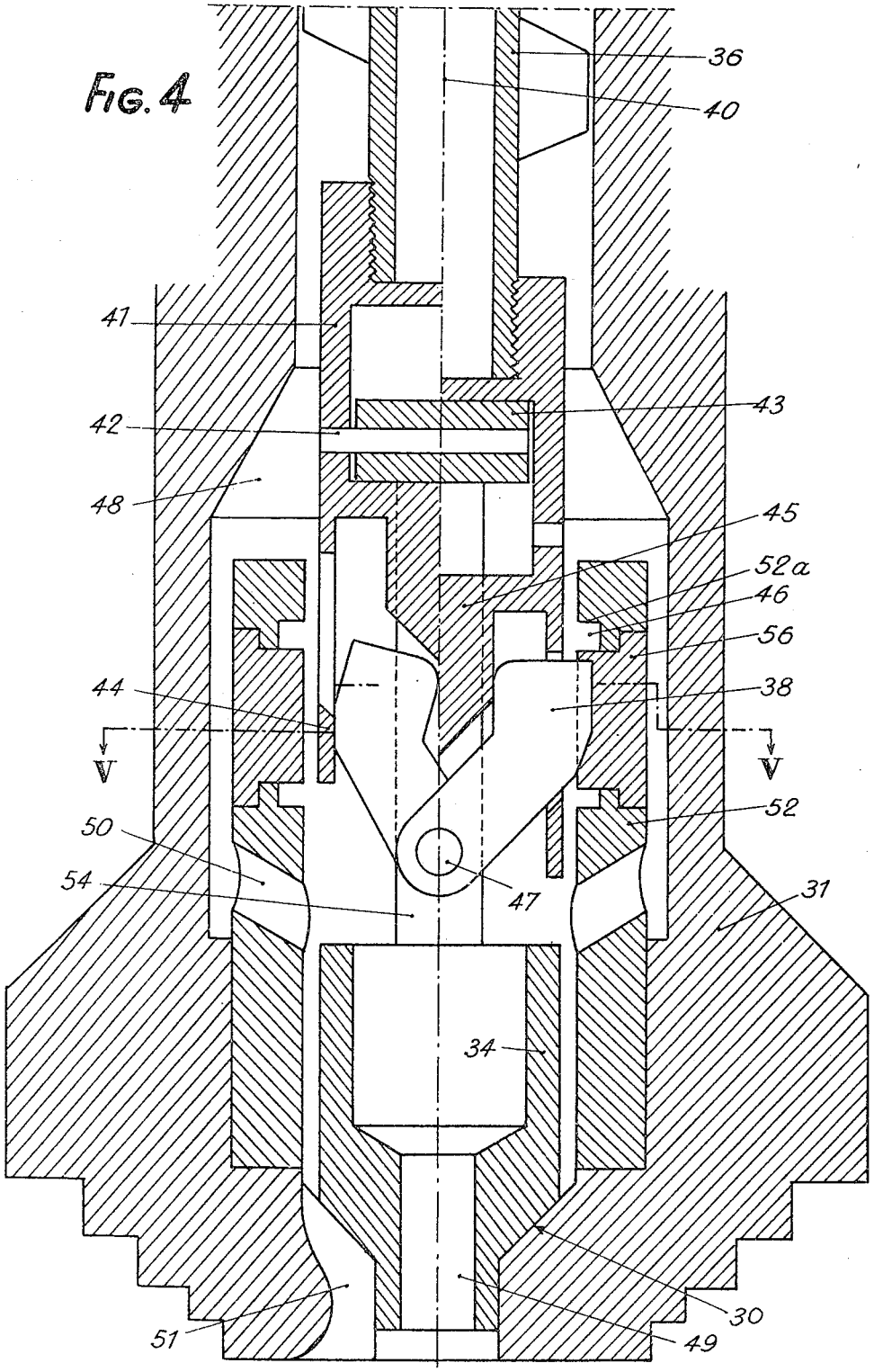

FIG. 3 shows the tool after withdrawal of the core barrel 8 and replacement of this assembly by the removable central portion of the drill tool designated by the general reference 32. The fishing part 9 is in that case fixed to a part 33 insuring the seal between the assembly 32 and the receiver tube 7 extending the upper portion of the shaft 6 of the turbine. The sealing part 33 cannot bear against the seating 13 because of the length of the assembly 32 the bottom end 34 of which, as shown in FIG. 4, bears against the seating 35 in the tool 31. In order to prevent any buckling due to the length of the bearer tube 36, fins 39 have been provided on this tube which passes right through the turbine. The coupling 37 connects the sealing part 33 to the tube 36 which is the bearer of the locking parts of the pawls 38 insuring lateral connection of the assembly 32 to the rotating shaft 6 of the turbine.

During the placement of the assembly 32 which may be effected by simple free fall into the injection mud for the turbine, the tube 36 lies in the position represented on the left of the central axis 40 at the moment at which the bottom end of the tube 34 rests against its seating 35. By increasing momentarily the mud pressure the pin 42 holding the cylinder 41 and the piston 43 shears. The fishing head 9 can drive further into the receiver tube 7 and push the tube 36 downwards. The latter brings about the fall of the locking mechanism of the assembly 32 comprising the locking parts 44 and 45 enabling the heads of the pawls 38 to be respectively introduced and driven out into the matching seats 46 in the cylindrical chamber 52 connected to the tool 31 driven by the shaft 6. It will be observed that the spindle 47 mounted on the support 54 about which the pawls 38 pivot is subjected to no force during the descent of the bearer cylinder 41 after the breaking of the shearpin 42 and that the driving tool is ready to operate as soon as the heads of the pawls have been driven into their seats 46.

Figure 5:
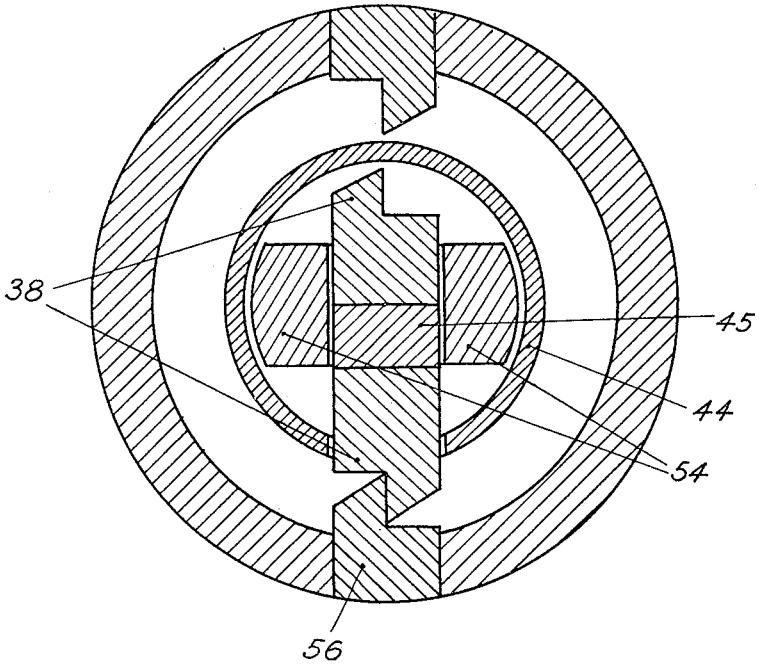

The sections V—V represented in FIG. 5 shows the successive arrangements of the pawls in the effacement position when the bolt has not yet descended and in the locking position in a window in the locking part 44 when the bolt 45 has descended as shown in FIG. 4. In this latter position the pawl 38 can bear laterally against an abutment 56 integral with the cylindrical chamber 52.

In order to show that the means of lateral connection between the assembly 32 and the revolving shaft 6 of the turbine may be of any kind, some preferred embodiments of the invention will be indicated.

Figure 6:
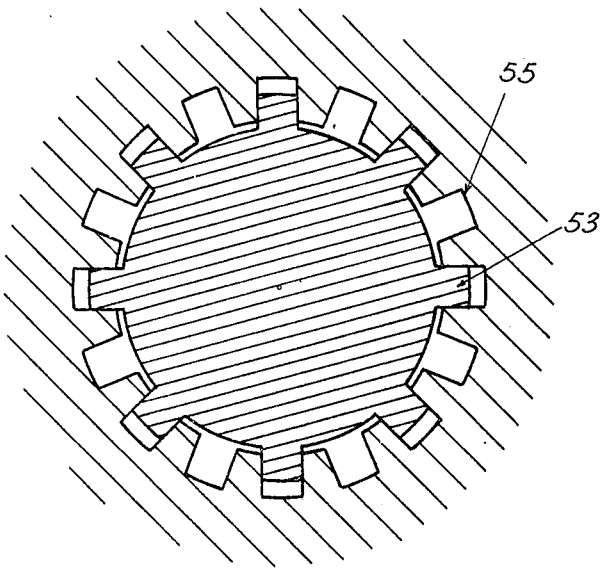
FIG. 6 - the view in section of the lateral connection of the removable central portion of the tool of FIG. 7, taken along the line VI—VI, and FIG. 7 - the diagrammatic view in axial section of the lower portion of the device equipped with a removable central portion without vertical locking mechanism.

Thus when the removable central portion is subjected to very large vertical forces the heads of the pawls 38 are given a shape enabling them to lock vertically against a rim 52a at the upper part of the seat 46 as shown in FIG. 4. Further, the supports 54 are integral with splines 53 such as those represented in FIG. 6 so that the lateral driving forces are distributed over the whole of the grooves 55 receiving the splines 53.

Figure 7:
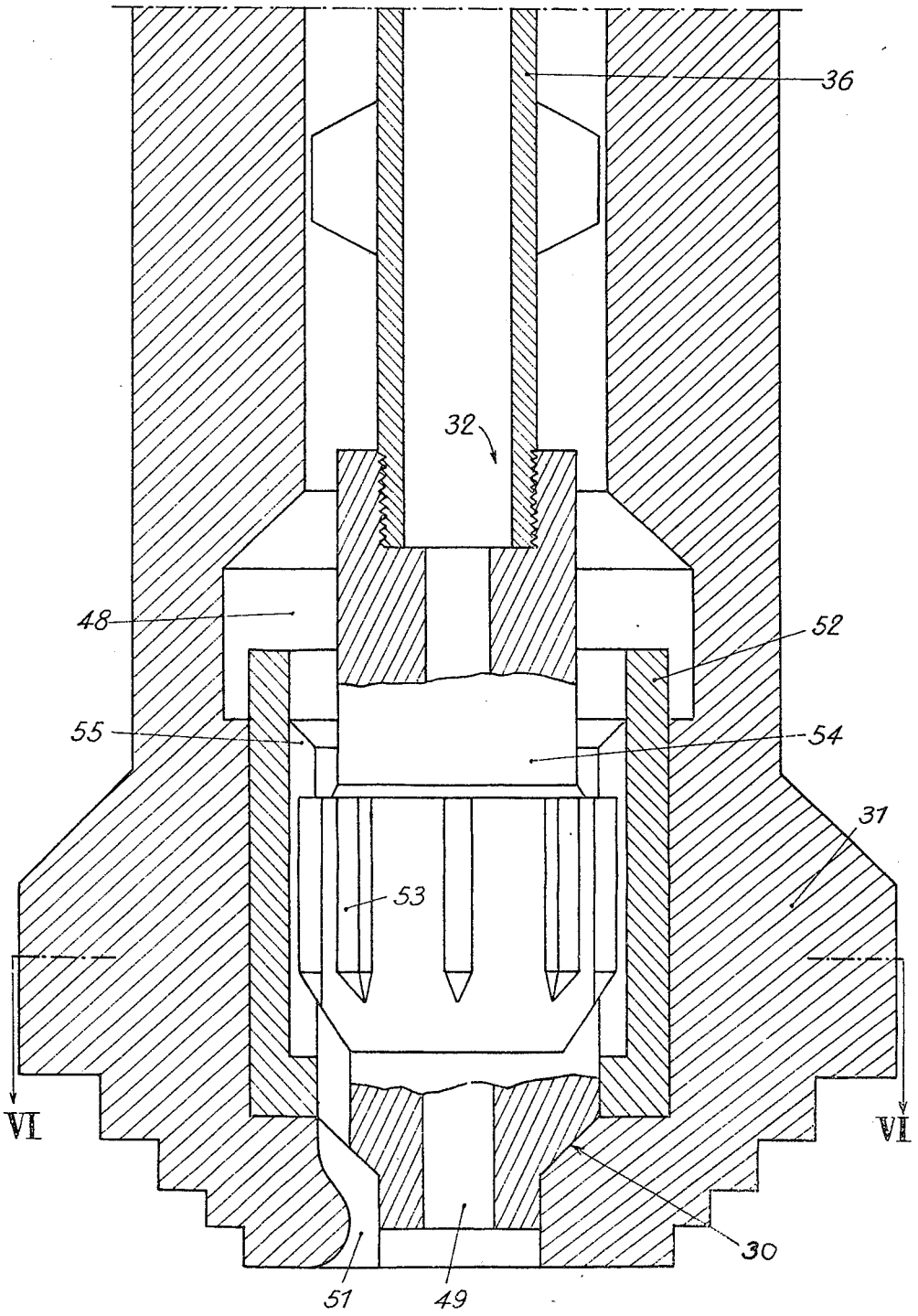

On the other hand when the bottom end of the removable central portion 32 is not subjected to considerable forces and the injection mud pressure for driving the turbine is sufficient to prevent the lifting of the removable central portion 32 under all conditions, the assembly as shown in FIG. 7 can be employed. In this variation in which no shearpin is necessary, no pawl for locking against lifting of the removable central portion 32 has been provided. The complete descent of the removable portion 32 may however necessitate a certain overpressure so that the splines 53 penetrate down to the bottom of the grooves 55 until the bottom of the part 54 comes to bear against the seating 35 of the tool.

Also in the case of the assembly means as shown in FIG. 4 the pin 42 can be omitted, the pawls having a profile designed both for tilting and bearing against the lateral abutments 56 and for disengaging themselves from the parts 56 and 52 according as the assembly 32 is pushed down or raised by means of the fishing head 9. For this purpose the profile of the rim 52a may also possibly be modified. In order to introduce and withdraw the assembly 32 easily the pin 42 can be omitted and the piston 43 replaced by another piston displaceable in the cylinder 41 only with a known quantity of friction, so that the pawls 38 do not lock during the descent or before the assembly rests against its seating 35.

Referring back to FIG. 4, the circulation of the drilling mud which comes from the turbine injection mud, is shown. The mud is channelled from the outlet 48 from the turbine towards the locking mechanism of the pawls 38 and towards the orifice 49 in the assembly 32 and also towards the channels 50 and towards the various orifices 51 provided around the axis of the tool. Thus by simple employment of the drilling mud pressure one can control the placement and the locking of the pawls 38 serving, possibly together with the splines 53, to lock the assembly 32 laterally with the cylindrical chamber 52 which in turn is integral with the drilling tool, the mud inlet circuits being effected simultaneously into the upper portion of the locking elements and to the lower portion of the assembly 32 through channels passing through the cylindrical support 52.

The devices represented in FIGS. 3 to 7 can be employed in the case of a drive by a pipe string controlled from the surface. Thus, in such a configuration in these figures the tool 31 is driven no longer by the shaft 6 of the turbine but by the pipe string in order to see that the device described can be employed as is, provided that at the internal surface of the tool which must receive the lateral locking devices on the removable central portion of the tool there is fixed a cylindrical chamber such as 52 which is extended upwards in order to receive the whole of the assembly composed of the fishing head 9, the sealing part 33, the tubes 36 and 41 carrying bolts 44–45 and grooves 55. Although the sealing part now plugs the upper portion of the cylinder 52, the parts 6 and 7 are no longer necessary and that by exercising sufficient pressure on the fishing head, lateral locking is obtained by shearing the pin 42 under the same conditions as before. It is clear that the various ways of lateral connection by means of pawls alone or splines alone or ways not employing shearpins nor locking with pawls, apply integrally to tools driven by a pipe string. As to the mud circuit, in the fishing head there or in the sealing head is provided at least one channel including one nozzle and leading thence to various orifices provided on the tool. The drop in pressure caused by the nozzle enables as in the case of the drive by turbine a very powerful application of the assembly of the central portion of the tool onto the seating provided in the tool to be preserved, this force of application being due to the high resieltant pressure to which the fishing head is subjected.

Thus irrespective of the type of drive of the tool and the connection mechanism of the removable central portion of the tool, the device which is the object of the invention enables its easy interchangeability with a core barrel without having to raise the tool to the surface and without premature wear on the connection with the core barrel.

I claim:

1. In a drilling device having a core barrel and a removable central portion of a drilling tool that are interchangeable, and a drive turbine, the improvement comprising: a first bearer tube associated with the central portion of the drilling tool and a second bearer tube associated with the core barrel, a receiver tube revolving within said drilling device, said receiving tube having a seating thereon to hold said first or second bearer tube in a vertical position, sealing means on said bearer tubes and cooperating with said receiver tube for isolating the top ends of said first and second bearer tubes from the injection of drilling mud, said core barrel and the removable central portion of the drilling tool having channels for the circulation of drilling mud at a pressure lower than the pressure of the mud above the sealing means, and friction reducing means for suspending said core barrel inside said receiver tube, said friction reducing means being lubricated by said circulating drilling mud at a pressure lower than the pressure above the sealing means.

2. A device as claimed in claim 1 wherein said friction reducing means suspends the core barrel inside the said receiver tube revolving with the tool by means of a ball-bearing assembly, the bearings being interposed between the bearer tube of the core barrel and a bearing support integral with the receiver tube.

3. In a drilling device having a core barrel and a removable central portion of a drill tool that are interchangeable, and a drive turbine, the improvement comprising: a first bearer tube associated with said core barrel and a second bearer tube associated with the central portion of the drilling tool; a receiver tube revolving within said drilling device, a seating on said receiver tube, said first or second bearer tube adapted to be held in a vertical position by said seating; sealing means applied to said bearer tubes and cooperating with said receiver tube for isolating the top ends of said bearer tubes from the injection of drilling mud, said core barrel and the removable central portion of the drill tool having channels for the circulation of drilling mud at a pressure lower than the pressure of the mud above said sealing means; said removable central portion of the tool comprises a piston fixed by a shear pin to the bearer tube of the central portion, and fixed to the piston by engaging means having pawls resting on a seating integral with the tool.

4. A device as claimed in claim 3, wherein the bearer tubes include locking parts actuated during the descent of the bearer tube when an overpressure is exerted on the sealing part.

5. In a drilling device having a core barrel and a removable central portion of a drilling tool that are interchangeable, and a drive turbine, the improvement comprising: a first bearer tube associated with the central portion of the drilling tool and a second bearer tube associated with the core barrel, a receiver tube revolving within said drilling device, said receiver tube having a seating thereon to hold said first or second bearer tube in a vertical position, sealing means on said bearer tubes and cooperating with said receiver tube for isolating the top ends of said first and second bearer tubes from the injection of drilling mud, said core barrel and the removable central portion of the drilling tool having channels for the circulation of drilling mud at a pressure lower than the pressure of the mud above the sealing means, the removable central portion of the drilling tool including splines engaging in grooves in a cylindrical part revolving with the receiver tube, and a tube integral with the sealing means at its upper end and with a splined lateral connection part at its lower portion.

* * * * *

UNITED STATES PATENT AND TRADEMARK OFFICE

CERTIFICATE OF CORRECTION

PATENT NO. : 3,951,219

DATED : April 20, 1976

INVENTOR(S) : Abel C. Cortes

It is certified that error appears in the above-identified patent and that said Letters Patent are hereby corrected as shown below:

IN THE SPECIFICATION:

Column 1, line 48, following "invention", delete "being".

Column 2, line 49, delete "illiminating" and insert --eliminating--;

line 57, following "tool," insert --showing details of the completed bit assembly not illustrated in Fig. 2,--;

lines 60-62, following "FIG. 4," delete "showing details of the completed bit assembly not illustrated in FIG. 2."

Column 3, line 45, following "at", delete "the";

line 54, after "valve-part", delete "of".

Column 4, line 50, delete "driving" and insert --drilling--.

Column 5, line 17, delete "of" and insert --on--.

Column 6, line 2, before "or" delete "there";

line 2, following "sealing head", insert --there--;

line 9, delete "resieltant" and insert --resilient--.

Signed and Sealed this

Fifth Day of October 1976

[SEAL]

*Attest:*

RUTH C. MASON
*Attesting Officer*

C. MARSHALL DANN
*Commissioner of Patents and Trademarks*